United States Patent [19]

Gerard

[11] 4,232,193

[45] Nov. 4, 1980

[54] MESSAGE SIGNAL SCRAMBLING APPARATUS

[75] Inventor: Roger E. J. Gerard, Chelmsford, England

[73] Assignee: The Marconi Company Limited, Chelmsford, England

[21] Appl. No.: 902,570

[22] Filed: May 3, 1978

[30] Foreign Application Priority Data

May 12, 1977 [GB] United Kingdom ..... 20074/77

[51] Int. Cl.[3] ..... H04K 1/06

[52] U.S. Cl. ..... 179/1.5 R; 375/2

[58] Field of Search ..... 179/1.5 R; 178/22

[56] References Cited

U.S. PATENT DOCUMENTS

| | | | |
|---|---|---|---|
| 2,913,525 | 11/1959 | Larsen | 179/1.5 R |
| 3,105,114 | 9/1963 | Koenig, Jr. | 179/1.5 R |
| 3,657,699 | 4/1972 | Rocher | 178/22 |
| 3,731,197 | 5/1973 | Clark | 178/22 |
| 3,773,977 | 11/1973 | Guanella | 179/1.5 R |
| 3,824,467 | 7/1974 | French | 179/1.5 R |
| 3,937,888 | 2/1976 | Myers | 179/1.5 R |
| 4,087,626 | 5/1978 | Brader | 178/22 |
| 4,100,374 | 7/1978 | Jayant et al. | 179/1.5 R |

*Primary Examiner*—Howard A. Birmiel

*Attorney, Agent, or Firm*—Diller, Ramik & Wight

[57] ABSTRACT

In a message signal scrambling apparatus, the signal is divided into elements, each of one time slot duration, and the elements are re-arranged in order so as to produce a signal scrambled in time. Each element is entered and stored in a charge coupled device, from which is extracted as required to form part of a re-arranged order of elements.

5 Claims, 1 Drawing Figure

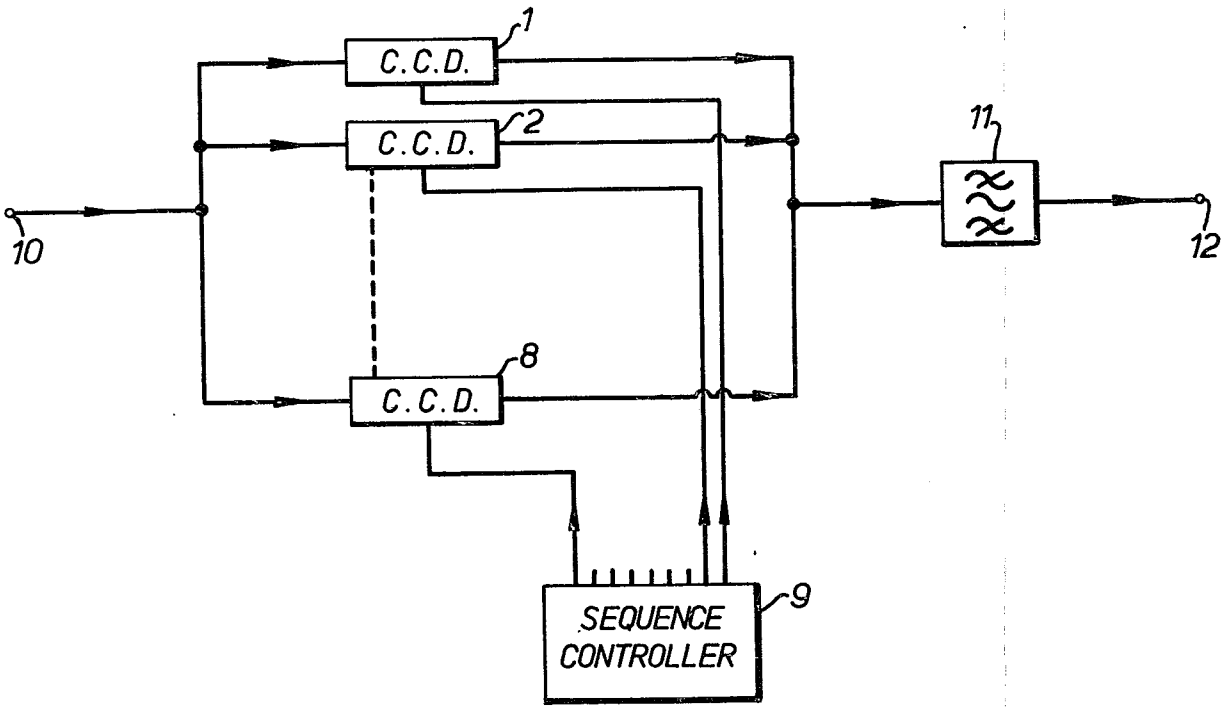
C.C.D.
C.C.D.
C.C.D.
SEQUENCE CONTROLLER
1
2
8
9
10
11
12

MESSAGE SIGNAL SCRAMBLING APPARATUS

This invention relates to message signal scrambling apparatus and more particularly to apparatus in which a message signal is scrambled in the time domain.

The scrambling of speech to make it unintelligible based upon the time scrambling technique involves dividing the speech into so-called time slots which are intervals of time of typically 30 ms duration and re-arranging the time slots in a predetermined code. The speech is de-scrambled at the receiving end using the same technique with a complementary code to restore the speech to its original form.

In a known message signal scrambling apparatus, an audio signal input is applied to an analogue-to-digital converter and thence to a gating arrangement which is operated under the control of a sequence controller. The gating arrangement has a plurality of gates which are each connected to a transistor logic store, each of the stores being arranged to store one time slot of the applied audio information. The stores are connected to a like plurality of gates in a further gating arrangement which is controlled by the sequence controller in like manner to the aforementioned gating arrangement and output from the further gating arrangement is converted back from a digital to an analogue form prior to being filtered by a low pass filter to remove frequency components due to the sampling frequency, and subsequently passed for utilisation. Because the known apparatus requires encoding (analogue-to-digital) and decoding (digital-to-analogue) stages, this approach tends to be expensive and, in a cost effective apparatus where the storage is kept to a minimum, the quality of the reconstituted speech is not high due to quantisation noise caused by the digitising process. The present invention seeks to provide an apparatus in which the foregoing disadvantages are at least partially mitigated.

According to one aspect of this invention, a message signal scrambling apparatus includes a plurality of charge coupled devices connected in parallel, each for storing a signal of at least one time slot duration, input and output terminal means for applying signals to and taking signals from the parallel combination respectively, and control means arranged to clock signals, applied in operation to the input terminal means, into and out of each one of the charge coupled devices in a predetermined coded manner so that the applied signal is scrambled in time.

According to a further aspect of this invention, a message signal de-scrambling apparatus includes a plurality of charge coupled devices connected in parallel, input and output terminal means for applying signals and taking signals from the parallel combination respectively, and control means arranged to clock signals, applied in operation to the input terminal means, into and out of each one of the charge coupled devices in a complementary manner to that in which the signal was coded so that the applied signal is de-scrambled.

Preferably, the de-scrambling apparatus has a like plurality of charge coupled devices as the scrambling apparatus.

By employing charge coupled devices, the present invention has the advantage that an analogue signal which is, preferably, an audio signal, may be applied to the charge coupled devices.

Conveniently, all of the charge coupled devices have the same storage capacity and hence have similar time delays to one another.

The charge coupled devices may, with advantage, have a storage capacity in excess of one time slot so that in operation the control means is arranged to clock information into and out of the devices at one predetermined rate and to clock the information stored in the devices along said devices at a different, slower, predetermined rate. Alternatively, the rate at which information is clocked out of the devices may be higher from that at which it was clocked into the devices.

Preferably, the predetermined code is a pseudo-random sequence generated in a manner known per se.

Advantageously, a low pass filter is connected between the parallel charge coupled device combination and the output terminal means to substantially remove spurious signals introduced at the clock frequency.

The invention will now be described, by way of example, with reference to the accompanying drawing which shows in block schematic form a message signal scrambling apparatus in accordance with this invention.

The apparatus shown in the drawing has eight charge coupled devices 1–8, only three of which are shown for clarity, namely 1, 2 and 8. The devices employed may be Mullard type No. TDA1022 which each have the capacity to store one time slot of audio information, i.e. 30 ms duration. The charge coupled devices 1–8 are controlled in a pseudo-random manner by the sequence controller 9 which clocks the devices 1–8 at a frequency of 8 KHz, this frequency being determined by the number of "buckets" in each of the charge coupled devices and the time slot duration. The parallel combination of charge coupled devices are connected to an input terminal 10 and, via a 300—3,000 Hz bandpass filter 11, to an output terminal 12. The purpose of the bandpass filter 11 is to remove components caused by the 8 KHz clock frequency and also those frequency components caused by the switching of the itme slots.

In operation, an audio signal applied at the input terminal 10 is applied to all of the charge coupled devices 1–8 simultaneously with no audio switching and the sequence controller 9 at initial switch on enters a time slot of information into a respective one of the eight charge coupled devices 1–8. However, the audio information stored in the devices 1–8 is read out of these devices in accordance with a pseudo-random sequence so that, for example, the sequence controller 9 clocks the time slot of information contained in device 2 out of this device whence it is filtered and applied to the output terminal 12. The next time slot of information clocked out of the parallel combination of devices may be time slot 8 contained in device 8 followed by the information stored in device 1 and corresponding to time slot 1 . . . and so on. Each time information is clocked out of a device, a new time slot of information is clocked into that device so that in the example just described where the information from time slot 8 was clocked out of device 8 first, then the information from time slot 9 would be clocked into the device 8, and so on.

The re-arrangement of the time slots at a receiving apparatus is controlled by a similar sequence controller driven in a complementary pseudo-random manner to that of the controller 9.

In the described embodiment, each of the charge coupled devices 1–8 has a storage capacity equivalent to one time slot but, in a further embodiment, the storage capacity of these devices may be larger than that required so that when one time slot of information has been clocked into a device, the device may be clocked at a much slower rate until the information is required for transmission whereupon it is clocked out of the device at the original rate. In this way, the number of combinations for interleaving the time slots at the output terminal 12 may be increased.

Alternatively, the rate at which stored information is clocked out of the devices may be different from that at which it was clocked into the devices thereby further reducing the intelligibility of the scrambled signal.

The present invention, thus, has the advantage that analogue signals may be stored directly without the need for digital encoding and hence involves no quantisation noise.

I claim:

1. A message signal scrambling apparatus including a plurality of charge coupled devices connected in parallel each for storing a signal of at least one time slot duration, input and output terminal means for applying signals to and taking signals from the parallel combination respectively, and control means arranged to clock signals, applied in operation to the input terminal means, into and out of each one of the charge coupled devices in a predetermined coded manner so that the applied signal is scrambled in time, the charge coupled devices having storage capacities in excess of one time slot so that in operation the control means is arranged to clock information into and out of the devices at one predetermined rate and to clock the information stored in the devices along said devices at a different, slower, predetermined rate.

2. A message signal de-scrambling apparatus including a plurality of charge coupled devices connected in parallel, input and output terminal means for applying signals and taking signals from the parallel combination respectively, and control means arranged to clock signals, applied in operation to the input terminal means, into and out of each one of the charge coupled devices in a complementary manner to that in which the signal was coded so that the applied signal is de-scrambled, the charge coupled devices having storage capacities in excess of one time slot so that in operation the control means is arranged to clock information into and out of the devices at one predetermined rate and to clock the information stored in the devices along said devices at a different, slower, predetermined rate.

3. An apparatus as claimed in claim 1 or 2 and wherein all of the charge coupled devices have the same storage capacity and hence have similar time delays to one another.

4. An apparatus as claimed in claim 1 or 2 and wherein the predetermined code is a pseudo-random sequence.

5. A message signal scrambling apparatus including a plurality of charge coupled devices each having a capacity of at least one time slot signal, input terminal means connected to all of said devices for providing a source of an analog message signal in parallel thereto and output terminal means connected in parallel to said devices for receiving time slot signals in interleaved fashion from different ones of said devices, and control means for clocking into and clocking out of each device a current time slot signal and a previously stored time slot signal respectively in predetermined coded sequence among said devices whereby the interleaved time slot signals are scrambled in time, the charged coupled devices having storage capacities in excess of one time slot so that in operation the control means is arranged to clock information into and out of the devices at one predetermined rate and to clock the information stored in the devices along said devices at a different, slower, predetermined rate.

* * * * *